United States Patent [19]

Lee et al.

[11] 4,056,366

[45] Nov. 1, 1977

[54] ZINC-ALUMINUM ALLOY COATING AND METHOD OF HOT-DIP COATING

[75] Inventors: Harvie Ho Lee, Glenwood, Ill.; David W. Gomersall, Valparaiso; Harry P. Leckie, Schererville, both of Ind.

[73] Assignee: Inland Steel Company, Chicago, Ill.

[21] Appl. No.: 644,109

[22] Filed: Dec. 24, 1975

[51] Int. Cl.[2] ..... C23C 1/02

[52] U.S. Cl. ..... 29/653; 75/178 A; 427/433; 427/329; 427/349; 428/659

[58] Field of Search ..... 427/433, 310, 329, 349; 29/196.2, 196.5; 75/178 A

[56] References Cited

U.S. PATENT DOCUMENTS

| | | | |
|---|---|---|---|
| 3,245,765 | 4/1966 | Lawson | 29/196.5 |
| 3,505,042 | 4/1970 | Sievert et al. | 29/196.2 |
| 3,505,043 | 4/1970 | Lee et al. | 29/196.5 |

OTHER PUBLICATIONS

Radeker, Effect of Alloying Elements on the Properties of Hot Dip Galvanized Coatings, Edited Proceedings 7th International Conference on Hot Dip Galvanizing, Paris 1964, pp. 167–178 Pergamon Press.

Bablik, Galvanizing, Third Ed. 1950, pp. 223,224,237,238 E. & F.N. Spon Ltd.

G. W. Roberts, Metallurgia, Aug. 1961, pp. 57–66.

McGannon, The Making Shaping and Treating of Steel 9th Ed., p. 1033.

*Primary Examiner*—Ralph S. Kendall

*Attorney, Agent, or Firm*—Hibben, Noyes & Bicknell

[57] ABSTRACT

A ferrous metal strip is continuously hot-dip coated by immersing the metal strip in a hot-dip coating bath containing between about 0.2 wt. percent and about 17 wt. percent aluminum, between about 0.02 wt. percent and about 0.15 wt. percent antimony while excluding lead in amounts more than 0.02 wt. percent, and the balance being essentially zinc. Smooth bright coatings are formed which are highly resistant to intergranular corrosion and blistering when exposed for an extended period to a hot humid atmosphere, have good formability in both the as coated state and after prolonged exposure to a hot humid atmosphere, have a markedly reduced susceptibility to the formation of white rust, and have a reduced rate of general surface corrosion without any diminution of the mechanical properties of the coating.

14 Claims, 8 Drawing Figures

ZINC-ALUMINUM ALLOY COATING AND METHOD OF HOT-DIP COATING

The present invention relates generally to a zinc-aluminum alloy coated ferrous metal strip and more particularly to a ferrous metal strip having a smooth bright zinc-aluminum alloy hot-dip coating which exhibits improved resistance to intergranular corrosion when exposed for prolonged periods to a high humidity atmosphere and which is further characterized by good formability properties and the absence of blisters both before and after prolonged exposure to a high humidity atmosphere, by a markedly reduced susceptibility to the formation of white rust, and by a reduced rate of general surface corrosion without any diminution in the mechanical properties of the coating.

In a continuous process of producing hot-dip galvanized sheet material in which an endless ferrous metal strip is continuously passed through a molten bath comprised mainly of metallic zinc so as to protect the ferrous metal against corrosion it has been found advantageous to include at least a small amount of aluminum in the zinc bath. Thus, adding from 0.15 to 0.3 wt.% aluminum to a zinc hot-dip galvanizing bath prevents forming a thick inter-metallic layer on the ferrous metal surface and improves the formability of the coated strip. It has also been found that adding larger amounts of aluminum to the zinc coating bath (i.e. from about 4 wt.% up to about 17 wt.%) further improves the resistance of the coating to surface corrosion without interferring with good formability.

When an endless steel strip is hot-dip coated with a zinc or a zinc-aluminum alloy in a modern continuous coating line, particularly when coating at low line speeds, the fluidity of the bath is such that it is difficult to form a smooth, ripple-free hot-dip coating having good paintability properties and an attractive appearance. In order to obtain a smooth, attractive hot-dip coating it has heretofore been considered necessary to include in the zinc-aluminum hot-dip coating bath a small but definite amount of lead to impart to the bath the required low surface tension so that a smooth ripple-free coating will be formed. The addition of lead to the coating baths also aids in the formation of spangles, particularly in the zinc coatings containing a small amount of aluminum (i.e. around 0.2 wt.% aluminum). In order to form a smooth hot-dip coating at least 0.06 wt.% lead is required in a hot-dip coating bath containing between about 0.2 wt.% and about 17 wt.% aluminum with the balance being essentially zinc and in commercial practice at least about 0.1 wt.% lead is used.

It has been found, however, that when a ferrous metal base is coated with zinc-aluminum alloy hot-dip coating which contains more than about 0.02 wt.% lead and the coating is exposed to a high humidity atmosphere for a prolonged period, as frequently occurs during normal storage, the surface of the hot-dip coating may appear entirely normal but the strip cannot be fabricated by deforming without having the coating separate from the base. Furthermore, when these zinc-aluminum hot-dip coating baths contain the minimum amount of lead required to provide a smooth ripple-free surface (i.e. at least 0.06 wt.% lead), pronounced blisters are formed on the surface of the coating, particularly along the grain boundaries, after the coated strip is exposed for a prolonged period to a high humidity atmosphere. These blisters were found to be the result of extensive intergranular corrosion which has caused localized lifting of the hot-dip coating. And, while the zinc-aluminum alloy coatings containing in excess of 0.02 wt.% lead and a relatively high concentration of aluminum (i.e. between about 4% and 17% by wt. aluminum) are particularly susceptible to intergranular corrosion, the entire range of zinc-aluminum alloy hot-dip coatings containing between about 0.2 wt.% to about 17 wt. % aluminum in the presence of more than 0.02 wt. % lead is subject to attack by intergranular corrosion which results in poor formability properties and which can cause surface blistering on prolonged exposure to a high humidity atmosphere. Zinc-aluminum alloys containing over 17.5 wt. % aluminum have a primary phase which behaves essentially as pure aluminum. The latter zinc-aluminum alloy coatings exhibit poor formability and poor coating adherence and hot-dip coatings which are not smooth even in the complete absence of lead and are not suitable for coating ferrous metal strips which must have good formability properties and paintability.

While zinc-aluminum alloy hot-dip coatings on a ferrous metal strip which are substantially lead-free (i.e. maximum of about 0.002 wt. % lead) do not exhibit intergranular corrosion or blistering when exposed to a high humidity atmosphere for a prolonged period, it is not practical to maintain the lead content of a hot-dip coating bath below 0.002 wt. %. Moreover, when the lead content of a zinc-aluminum alloy hot-dip coating bath is reduced to a level of about 0.05 wt. % or below, the surface tension of the bath is such that the hot-dip coating applied on a continuous coating line has objectionable ripples and the surface is not sufficiently smooth to satisfy the trade. Thus, there remains the problem of providing a zinc-aluminum alloy hot-dip coating having both a smooth bright coating appearance and good resistance to intergranular corrosion when exposed to a high humidity atmosphere for a prolonged period.

It is therefore an object of the present invention to provide a ferrous metal base having a smooth zinc-aluminum alloy coating which is resistant to intergranular corrosion and blistering caused by inergranular corrosion on exposure for a prolonged period to a high humidity atmosphere.

It is a further object of the present invention to provide an improved hot-dip coating bath for applying to a ferrous metal sheet a smooth bright hot-dip coating which is resistant to intergranular corrosion and blistering caused by intergranular corrosion on exposure for a prolonged period to a high humidity atmosphere.

It is still another object of the present invention to provide a process for continuously applying to a ferrous metal sheet a smooth bright hot-dip coating which is resistant to intergranular corrosion and blistering caused by intergranular corrosion on exposure for a prolonged period to a high humidity atmosphere.

It is also an object of the present invention to provide an improved method of controlling intergranular corrosion of a zinc-aluminum alloy hot-dip coating on a ferrous metal strip.

Other objects of the present invention will be apparent to those skilled in the art from the following detailed description and claims when read in conjunction with the accompanying drawing, wherein:

Figure 1:
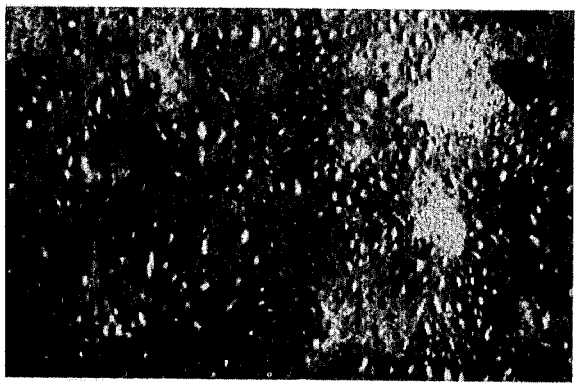
FIG. 1 is a plan view at 9X magnification of the unetched surface of a hot-dip coated ferrous metal panel (i.e. 20 gauge rimmed steel) after four weeks exposure to a condensing humidity atmosphere at a temperature of 130° F wherein the hot-dip coating is a 5 wt. % aluminum-zinc alloy containing 0.1 wt. % lead with the balance essentially zinc.
Figure 2:
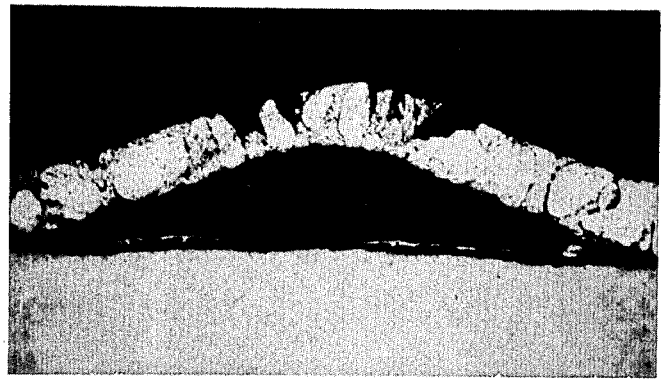
FIG. 2 is a vertical sectional view of the unetched panel of FIG. 1 showing the microstructure at 600X magnification of one portion of the hot-dip coated ferrous metal panel.
Figure 3:
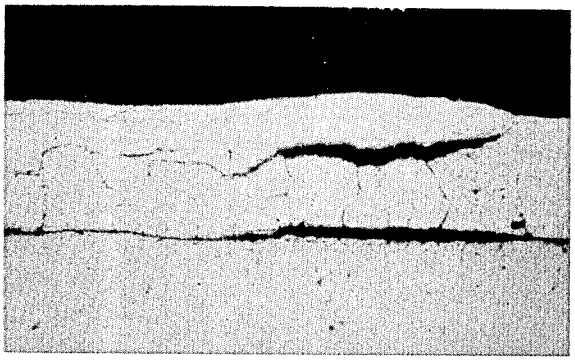
FIG. 3 is a vertical sectional view of an unetched hot-dip coated ferrous metal panel (i.e. 20 gauge rimmed steel) showing the microstructure at 600X magnification after exposure for two weeks at 176° F to a 92% relative humidity atmosphere wherein the hot-dip coating is a 0.2 wt. % aluminum-zinc alloy coating containing 0.1 wt. % lead with the balance essentially zinc.
Figure 4:
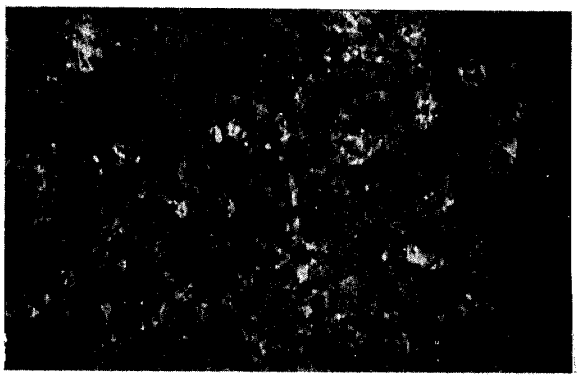
FIG. 4 is a plan view of a hot-dip coated ferrous metal panel (i.e. 20 gauge rimmed steel) showing the surface after two weeks exposure to a condensing humidity atmosphere at 130° F wherein the coating is a 5 wt. % aluminum-zinc alloy containing 0.1 wt. % antimony and less than 0.01 wt. % lead with the balance essentially zinc.
Figure 5:
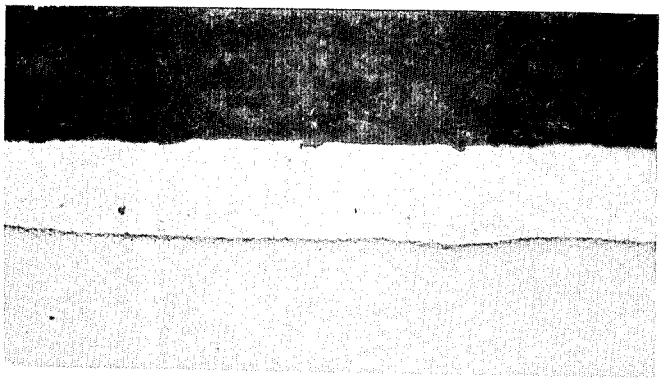
FIG. 5 is a vertical sectional view of the unetched panel of FIG. 4 showing the microstructure at 600X magnification of one portion of the hot-dip coated ferrous metal panel.
Figure 6:
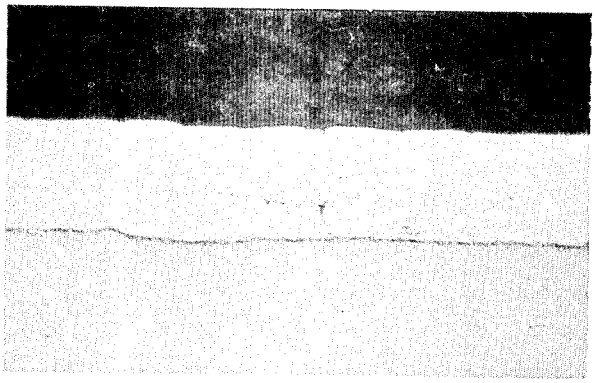
Figure 7:
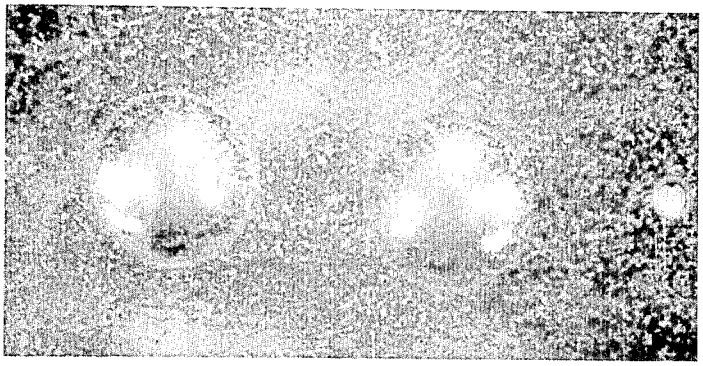
Figure 8:
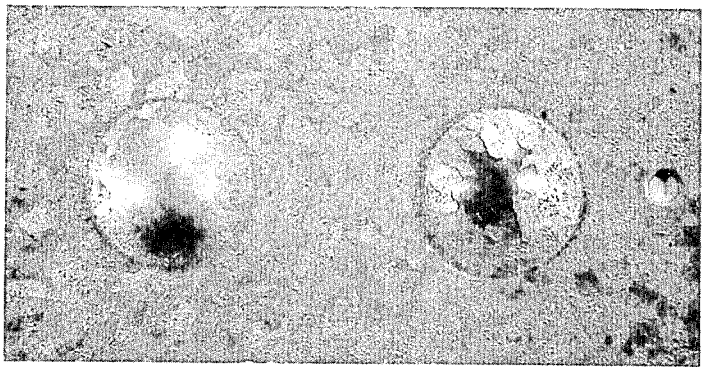

FIG. 6 is a vertical sectional view of an unetched ferrous metal panel (i.e. 20 gauge rimmed steel) showing the microstructure at 600X magnification of one portion of the hot-dip coated ferrous metal panel after exposure to a 92% relative humidity atmosphere at 176° F for two weeks wherein the coating is a 0.2 wt. % aluminum-zinc alloy containing 0.1 wt. % antimony and 0.01 wt. % lead with the balance essentially zinc;

FIG. 7 is a plan view of an unetched ferrous metal panel (i.e. 20 gauge rimmed steel) hot-dip coated with a 5.0 wt. % aluminum-zinc alloy containing 0.05 wt. % antimony and less than 0.01 wt. % lead with the balance essentially zinc subjected to a conventional 120 inch-pound impact test before and after exposure of the panel for a period of seven days in a humidity cabinet having a 92% relative humidity at a temperature of 176° F; and FIG. 8 is a plan view of an unetched hot-dip coated ferrous metal panel (i.e. 20 gauge rimmed steel) hot-dip coated with a 5.0 wt. % aluminum-zinc alloy containing 0.15 wt. % antimony, 0.1 wt. % lead with the balance essentially zinc subjected to a conventional 120 inch-pound impact test before and after exposure of the panel for a period of seven days in a humidity cabinet having a 92% relative humidity at a temperature of 176° F.

The several objects of the present invention are achieved by continuously hot-dip coating a ferrous metal sheet in a zinc-aluminum alloy hot-dip coating bath which has a low lead content (i.e. a maximum of 0.02 wt. % lead), and which contains between about 0.2 wt. % and about 17 wt. % aluminum, and between about 0.02 and 0.15 wt. % antimony with the balance being essentially zinc. Whereas it has heretofore been considered essential to use at least about 0.06 wt. % lead and up to about 0.15 wt. % lead in a zinc-aluminum alloy hot-dip coating bath containing between about 0.2 to about 17 wt. % aluminum in order to reduce the surface tension sufficiently to form a ripple-free surface and provide a coating having an attractive appearance, it has now been found that by maintaining the lead content of the bath at a maximum of about 0.02 wt. %, and preferably not more than 0.01 wt. % lead, and adding antimony to the bath in an amount between about 0.02 wt. % and about 0.15 wt. %, the coating bath will have a surface tension required to form a smooth ripple-free hot-dip coated surface, will have the desired bright smooth appearance and, most significantly, will not exhibit significant intergranular corrosion nor form blisters caused by intergranular corrosion when the hot-dip coating is exposed to a high humidity atmosphere for a prolonged period. Furthermore, it has been found that the addition of antimony to an aluminum-zinc alloy coating bath has a greater effect in reducing the surface tension of the bath and produces, particularly in the 0.2% aluminum-zinc coatings, a significantly larger flatter grain or spangle size than the same concentration of lead provides in an otherwise identical zinc-aluminum coating bath and without causing any of the adverse effects of lead disclosed herein. It has also been discovered that by the having antimony in the zinc-aluminum hot-dip coating in the amount specified herein while the lead concentration is maintained at a maximum of about 0.02 wt. %, the susceptibility of the zinc-aluminum alloy coating to white rust is markedly reduced and the rate of general surface corrosion of the hot-dip coated ferrous metal sheet is also reduced without causing any adverse effects on the mechanical properties of the hot-dip coating.

To illustrate the invention a series of 5 wt. % aluminum-zinc alloy hot-dip coating baths were prepared from pure aluminum and pure zinc to provide coating baths containing 5 wt. % aluminum, with antimony and lead contents as indicated in the following Table I, and with the balance being essentially zinc. Each bath was saturated with iron to provide an iron concentration of about 0.02 wt. % (which corresponds to the normal iron build up in a continuous hot-dip galvanizing bath). A series of 20-gauge rimmed steel panels (4 × 8 inches in size) were hot-dip coated in the baths. The steel had a chemical composition as follows: about 0.08% carbon, 0.29% to 35% manganese, 0.01% to 0.011% phosphorus, 0.019% to 0.020% sulfur, and 0.04% copper, with the balance essentially iron. All the panels were precleaned by oxidizing in a furnace at 1650° F for 30 seconds, and the oxidized panels were then transferred into a laboratory "dry box" which contained the coating baths and laboratory galvanizing equipment. The reducing atmosphere inside the "dry box" comprised 10% hydrogen with the balance nitrogen. The dew point inside the dry box was always kept below −15° F during the hot-dip coating operation. The clean panels were preheated at 1700° F for 3 minutes in the reducing atmosphere of the dry box to effect removal of all surface oxides and then cooled while being maintained within the reducing atmosphere of the dry box to the hot-dip coating bath temperature of about 820° F. The immersion time in the coating bath for each panel was about 5 seconds to provide an average coating weight of about 0.5 oz. per sq. ft. The several hot-dip coated panels, after two weeks exposure to a 92% R. H. atmosphere and at a temperature of 176° F, were examined to determine the degree of intergranular corrosion and blistering, and the result for the several coatings are tabulated in the following Table I:

TABLE I

| Wt. % Aluminum-Zinc Alloy Coating Bath[1] Additives (Wt. %) | Coating Characteristics After Exposure To High Humidity Atmosphere[2] |
|---|---|
| 1. 0.01% Lead, No Antimony | No intergranular corrosion - No Surface Blisters |
| 2. 0.02% Lead, No Antimony | No Intergranular Corrosion - No |

TABLE I-continued

| Wt. % Aluminum-Zinc Alloy Coating Bath[1] Additives (Wt. %) | Coating Characteristics After Exposure To High Humidity Atmosphere[2] |
|---|---|
| | Surface Blisters |
| 3. 0.04% Lead, No Antimony | Slight Intergranular Corrosion - No Surface Blisters |
| 4. 0.05% Lead, No Antimony | Intergranular Corrosion - Few Surface Blisters |
| 5. 0.06% Lead, No Antimony | Intergranular Corrosion - Suface Blisters |
| 6. 0.08% Lead, No Antimony | Severe Intergranular Corrosion - Surface Blisters |
| 7. 0.1% Lead, No Antimony | Severe Intergranular Corrosion - Surface Blisters |
| 8. 0.02% Antimony, <0.01% Lead | No Intergranular Corrosion - No Surface Blisters |
| 9. 0.05% Antimony <0.01% Lead | No Intergranular Corrosion - No Surface Blisters |
| 10. 0.10% Antimony <0.01% Lead | No Intergranular Corrosion - No Surface Blisters |
| 11. 0.15% Antimony <0.01% Lead | No Intergranular Corrosion - No Surface Blisters |
| 12. 0.15% Antimony, 0.1% Lead | Severe Intergranular Corrosion - Surface Blisters |
| 13. 0.1% Antimony, 0.02% Lead | No Intergranular Corrosion - No Surface Blisters |
| 14. 0.1% Antimony, 0.06% Lead | Intergranular Corrosion - Few Surface Blisters |
| 15. 0.1% Antimony, 0.1% Lead | Severe Intergranular Corrosion - Surface Blisters |

[1]Before additives the coating bath contains 0.02 wt. % iron with balance essentially pure zinc and aluminum.
[2]92% R. H. atmosphere at 176° F for two weeks.

A series of aluminum-zinc alloy hot-dip coated panels were prepared in the same manner as described in connection with the coatings of Table I, but wherein the aluminum content of the alloy was 0.2 wt. % aluminum and with varying amounts of lead and antimony. The test results after the same exposure as in Table I are shown in the following Table II:

TABLE II

| 0.2 wt. % Aluminum-Zinc Alloy Coating Bath[1] Additives (Wt. %) | Coating Characteristics After Exposure To A High Humidity Atmosphere[2] |
|---|---|
| 1. <0.01% Lead, No Antimony | No Intergranular Corrosion - No Surface Blisters - No Spangles |
| 2. 0.02% Lead, No Antimony | No Significant Intergranular Corrision, No Surface Blisters - No Significant Spangles |
| 3. 0.05% Lead, No Antimony | Intergranular Corrosion - Very Small Surface Blisters Along Spangle Boundaries - Spangles |
| 4. 0.1% Lead, No Antimony | Intergranular Corrosion - Surface Blisters Along Spangle Boundaries Spangles |
| 5. 0.18% Lead, No Antimony | Intergranular Corrosion - Surface Blisters Along Spangle Boundaries Spangles |
| 6. 0.05% Antimony, 0.01% Lead | No Intergranular Corrosion - No Surface Blisters - Spangles |
| 7. 0.07% Antimony, 0.01% Lead | No Intergranular Corrosion - No Surface Blisters - Spangles |
| 8. 0.1% Antimony, 0.01% Lead | No Intergranular Corrosion - No Surface Blisters - Spangles |
| 9. 0.16% Antimony, 0.01% Lead | No Intergranular Corrision - No Surface Blisters - Spangles |

[1]Before additives coating bath contains 0.02 wt. % iron with balance essentially pure zinc and aluminum.
[2]Same exposure as in Table I.

When exposing zinc-aluminum alloy compositions containing 10 wt. % and 15 wt. % aluminum and between 0.02 and 0.15 wt. % antimony with a maximum of 0.02 wt. % lead to a 92% R. H. atmosphere at 176° F for two weeks, results similar to those shown in Tables I and II are obtained. No evidence of significant intergranular corrosion of surface blisters was found after exposing the 10 wt. % and 15 wt. % aluminum-zinc alloys containing 0.05 wt. % and 0.10 wt. % antimony with the lead content maintained below 0.01 wt. % to a 92% R. H. atmosphere at 176° F for two weeks. In the coatings of Tables I and II which contain at small amount of antimony (i.e. 0.02 – 0.05 wt. %), the lead content was maintained below 0.02 wt. % (i.e. at a lead concentration of 0.01 wt. % or below).

In order to further illustrate the present invention a continuous strip of mild galvanizing steel was continuously coated on a Sendzimir-type continuous hot-dip galvanizing coating pilot line wherein the steel strip had a chemical composition on a weight basis of about 0.08% carbon, 0.29% to 0.35% manganese, 0.01% to 0.011% phosphorus, 0.019% to 0.020% sulfur and 0.04% copper with the balance being essentially iron. A 5 wt. % aluminum-zinc alloy hot-dip coating bath contained a maximum of 0.02% lead and about 0.07 wt. % antimony with the balance being essentially zinc was applied to the steel strip by continuously passing the strip through a controlled atmosphere in which the surface contaminants were burned off and the surface of the strip reduced in a hydrogen atmosphere to remove surface oxides, generally in accordance with a conventional Sendzimir process. The strip, in the alternative, could have ben chemically cleaned by means of an alkaline cleaning bath. The clean strip at a temperature of about 830° F was then passed continuously through the above alloy hot-dip coating bath at a rate of between about 30 to 60 ft. per minute with a dwell time in the bath between about 4 and 8 seconds. Steam at a temperature of 900° F was impinged upon the coating as the strips were removed from the coating bath to provide the strip with a coating weight of about 0.5 ounce per sq. ft. The strip was air quenched, and the hot-dip coatings had a smooth bright appearance. The strip showed no evidence of intergranular corrosion or blistering when exposed to a condensing humidity atmosphere at 130° F for two weeks.

Because of the very flat grain formed on the surface of the hot-dip coated strip the foregoing 5 wt. % aluminum-zinc alloy hot-dip coatings exhibited an unusually bright smooth appearance without the typical spangle pattern. The surface of these 5 wt. % aluminum-zinc alloy hot-dip coatings is characterized by the absence of the usual intersecting crystal pattern or "spangle" found in conventional galvanized hot-dip coatings. On very close examination of the 5 wt. % aluminum-zinc coatings of the present invention small sub-surface polygonal grain boundaries are evident which resemble an alligator skin pattern. After prolonged exposure to a high-humidity atmosphere, a fine outwardly radiating pattern is developed within each of the grain boundaries without, however, forming the typical spangle appearance. Thus, in the 5 wt. % aluminum-zinc alloy hot-dip coatings prepared in accordance with the present invention, a novel and very pleasing surface appearance is formed which distinguishes the product from conventional 0.2 wt. % aluminum-zinc alloy hot-dip coatings.

While the improved coatings are preferably continuously applied as hot-dip coatings, it is within the scope of the invention to form the coatings by metal spraying, if desired.

We claim:

1. A ferrous metal sheet having on a surface thereof a zinc-aluminum alloy continuous hot-dip coating consisting essentially of between about 0.2 wt. % and about 17 wt. % aluminum, between about 0.02 wt. % and about 0.15 wt. % antimony and a maximum of about 0.02 wt. % lead with the balance essentially zinc, and said alloy coating characterized by having a smooth bright ripple-free surface which is resistant to intergranular corrosion and blistering along grain boundaries when exposed for prolonged periods to a high humidity atmosphere, and said coating being formable without having the coating separate from the sheet both before and after prolonged exposure to said high humidity atmosphere.

2. A ferrous metal sheet as in claim 1, wherein said alloy coating contains about 0.2 wt. % aluminum, about 0.1 wt. % antimony and about 0.01 wt. % lead.

3. A ferrous metal sheet as in claim 1 wherein said alloy coating contains between about 4 wt. % and about 17 wt. % aluminum.

4. A ferrous metal sheet as in claim 1, wherein said alloy coating contains about 5 wt. % aluminum, about 0.1 wt. % antimony and about 0.01 wt. % lead, and is further characterized by the absence of conventional surface spangles and having a sub-surface which has polygonal grain boundaries.

5. A hot-dip coating bath consisting essentially of between about 0.2 wt. % and about 17 wt. % aluminum, between about 0.02 wt. % and about 0.15 wt. % antimony and a maximum of about 0.02 wt. % lead with the balance essentially zinc.

6. A hot-dip coating bath as in claim 5, wherein said coating bath contains 0.2 wt. % aluminum, about 0.1 wt. % antimony and about 0.01 wt. % lead.

7. A hot-dip coating bath as in claim 5, wherein said coating bath contains between about 4 wt. % and about 17 wt. % aluminum.

8. A hot-dip coating bath as in claim 5, wherein said bath contains about 5 wt. % aluminum, about 0.1 wt. % antimony and about 0.01 wt. % lead.

9. A method of providing a ferrous metal sheet with a smooth bright ripple-free continuous hot-dip coating which is highly resistant to intergranular corrosion and blistering along grain boundaries when exposed to a hot humid atmosphere comprising; continuously passing an endless ferrous metal sheet through a hot-dip coating bath comprised essentially of between about 0.2 wt. % and about 17 wt. % aluminum, between about 0.02 wt. % and about 0.15 wt. % antimony and a maximum of about 0.02 wt. % lead with the balance being essentially zinc, and said bath containing said antimony in an amount which reduces the surface tension of said bath such that said smooth bright ripple-free coating is formed as said sheet is continuously withdrawn from said bath.

10. A method as in claim 9, wherein said coating bath contains about 0.2 wt. % aluminum, about 0.1 wt. % antimony and about 0.01 wt. % lead.

11. A method as in claim 9, wherein said coating bath contains between about 4 wt. % and about 17 wt. % aluminum.

12. A method as in claim 9, wherein said coating bath contains about 5% by wt. aluminum, about 0.1 wt. % antimony and about 0.01 wt. % lead.

13. A method as in claim 9, wherein said metal sheet is clean and free of surface oxides when immersed in said bath.

14. A method as in claim 9, wherein said metal sheet passes between jets of blowing gas as said metal sheet is continuously withdrawn from said bath.

* * * * *